US007741998B2

(12) United States Patent
Thornell-Pers

(10) Patent No.: US 7,741,998 B2
(45) Date of Patent: Jun. 22, 2010

(54) ANTENNA DEVICE AND PORTABLE RADIO COMMUNICATION DEVICE COMPRISING SUCH AN ANTENNA DEVICE

(75) Inventor: Anders Thornell-Pers, Beijing (CN)
(73) Assignee: Laird Technologies AB (SE)

( * ) Notice: Subject to any disclaimer, the term of this patent is extended or adjusted under 35 U.S.C. 154(b) by 275 days.

(21) Appl. No.: 10/597,192

(22) PCT Filed: Feb. 1, 2005

(86) PCT No.: PCT/SE2005/000115

§ 371 (c)(1),
(2), (4) Date: Oct. 28, 2008

(87) PCT Pub. No.: WO2005/074070

PCT Pub. Date: Aug. 11, 2005

(65) Prior Publication Data

US 2009/0066584 A1 Mar. 12, 2009

(30) Foreign Application Priority Data

Feb. 2, 2004 (SE) ..... 0400203

(51) Int. Cl.
*H01Q 1/38* (2006.01)
*H01Q 1/24* (2006.01)
*H01Q 3/24* (2006.01)

(52) U.S. Cl. ..... 343/700 MS; 343/702; 343/876

(58) Field of Classification Search ..... 343/700 MS, 343/702, 818, 876, 893
See application file for complete search history.

(56) References Cited

U.S. PATENT DOCUMENTS 6,417,813 B1 7/2002 Durham
6,930,639 B2 * 8/2005 Bauregger et al. .... 343/700 MS
7,057,472 B2 * 6/2006 Fukamachi et al. ..... 333/101
2008/0224942 A1 9/2008 von Arbin

FOREIGN PATENT DOCUMENTS

| | | | |
|---|---|---|---|
| EP | 1 237 222 | A1 | 9/2002 |
| EP | 1 361 623 | A1 | 11/2003 |
| EP | 1714351 | B1 | 4/2009 |
| GB | 2 335 798 | A | 3/1998 |
| JP | 11298231 | | 10/1999 |
| JP | 2000236209 | | 8/2000 |
| WO | WO 01/20718 | A1 | 3/2001 |

OTHER PUBLICATIONS

May 21, 2007: EP Communication pursuant to Article 96(2).

* cited by examiner

*Primary Examiner*—Shih-Chao Chen
(74) *Attorney, Agent, or Firm*—Harness, Dickey & Pierce, P.L.C.

(57) ABSTRACT

An antenna device for a portable radio communication device operable in at least a first and a second frequency band, includes first and second electrically conductive planar radiating elements. The first radiating element has a feeding portion connectable to a feed device of the portable radio communication device. The second radiating element includes a grounding portion connectable to ground. A controllable switch is arranged between the first and second radiating elements for selectively interconnecting and disconnecting the radiating elements. The state of the switch is controlled by means of a control voltage input. A first filter is arranged between the feeding portion and the control voltage input, to block radio frequency signals. By providing a high pass filter between the first and second radiating elements above a ground plane, quad-band operation is provided with high efficiency in a physically small antenna device.

20 Claims, 7 Drawing Sheets

Switch 130 open
Switch 144 open

Switch 130 closed
Switch 144 open

Switch 130 open
Switch 144 closed

Switch 130 closed
Switch 144 closed

ANTENNA DEVICE AND PORTABLE RADIO COMMUNICATION DEVICE COMPRISING SUCH AN ANTENNA DEVICE

FIELD OF INVENTION

The present invention relates generally to antenna devices and more particularly to a controllable internal multi-band antenna device for use in portable radio communication devices, such as in mobile phones. The invention also relates to a portable radio communication device comprising such an antenna device.

BACKGROUND

Internal antennas have been used for some time in portable radio communication devices. There are a number of advantages connected with using internal antennas, of which can be mentioned that they are small and light, making them suitable for applications wherein size and weight are of importance, such as in mobile phones. A type of internal antenna that is often used in portable radio communication devices is the so-called Planar Inverted F Antenna (PIFA).

However, the application of internal antennas in a mobile phone puts some constraints on the configuration of the antenna, such as the dimensions of the radiating element or elements, the exact location of feeding and grounding portions etc. These constraints may make it difficult to find a configuration of the antenna that provides a wide operating band. This is particularly important for antennas intended for multi-band operation, wherein the antenna is adapted to operate in two or more spaced apart frequency bands. In a typical dual band phone, the lower frequency band is centered on 900 MHz, the so-called GSM 900 band, whereas the upper frequency band is centered around 1800 or 1900 MHz, the DCS and PCS band, respectively. If the upper frequency band of the antenna device is made wide enough, covering both the 1800 and 1900 MHz bands, a phone operating in three different standard bands is obtained. In the near future, antenna devices operating four or even more different frequency bands are envisaged.

The number of frequency bands in passive antennas is limited by the size of the antenna. To be able to further increase the number of frequency bands and/or decrease the antenna size, active frequency control can be used. An example of active frequency control is disclosed in the Patent Abstracts of Japan 10190347, which discloses a patch antenna device capable of coping with plural frequencies. To this end there are provided a basic patch part and an additional patch part which are interconnected by means of PIN diodes arranged to selectively interconnect and disconnect the patch parts. Although this provides for a frequency control, the antenna device still has a large size and is not well adapted for switching between two or more relatively spaced apart frequency bands, such as between the GSM and DCS/PCS bands. Instead, this example of prior art devices is typical in that switching in and out of additional patches has been used for tuning instead of creating additional frequency band at a distance from a first frequency band.

The Patents Abstracts of Japan publication number JP2000-236209 discloses a monopole antenna comprising a linear conductor or on a dielectric substrate, see FIG. 1. Radiation parts of the antenna are composed of at least two metal pieces connected through diode switch circuits. The radiation elements have feed points connected to one end of a filter circuit, which cuts of a high-frequency signal. A signal $V_{Scwitch}$ is used to control the diode switch. The disclosed configuration is limited to monopole or dipole antennas. Also, the object of the antenna according to the above mentioned Japanese document is not to provide an antenna with a small size.

A problem in prior art antenna devices is thus to provide a multi-band antenna of the PIFA type with a small size and volume and broad frequency bands which retains good performance.

SUMMARY OF THE INVENTION

An object of the present invention is to provide an antenna device of the kind initially mentioned wherein the frequency characteristics provides for four comparatively wide frequency bands while the overall size of the antenna device is small.

Another object is to provide an antenna device having better multi-band performance than prior art devices.

The invention is based on the realization that several frequency bands can be provided in a physically very small antenna by arranging the antenna so that first portions of two radiating elements are interconnected for radio frequency signals and second portions of the radiating elements are selectively interconnectable by means of a switch controlled by means of a DC voltage. This DC voltage is applied to a control input wherein a filter arrangement that is provided between the RF feeding portion and the DC control input blocks RF signals.

According to a first aspect of the present invention there is provided an antenna device as defined in claim 1.

According to a second aspect of the present invention there is provided portable radio communication device as defined in claim 10.

Further preferred embodiments are defined in the dependent claims.

The invention provides an antenna device and a portable radio communication device wherein the problems in prior art devices are avoided or at least mitigated. Thus, there is provided a multi-band antenna device having an antenna volume as small as about 3 $cm^3$ which means a size of the antenna that is reduced as compared to standard multi-band patch antennas but still with maintained RF performance. Also, the bandwidths of the antenna device according to the invention can be improved as compared to corresponding prior art devices but without any increase in physical size, which is believed to be a result of the use of the dual band antenna structure.

The switch is preferably a PIN diode, having good properties when operating as an electrically controlled RF switch.

BRIEF DESCRIPTION OF DRAWINGS

The invention is now described, by way of example, with reference to the accompanying drawings, in which.

DETAILED DESCRIPTION OF THE INVENTION

In the following, a detailed description of preferred embodiments of an antenna device according to the invention will be given. In the description, for purposes of explanation and not limitation, specific details are set forth, such as particular hardware, applications, techniques etc. in order to provide a thorough understanding of the present invention. However, it will be apparent to one skilled in the art that the present invention may be utilized in other embodiments that depart from these specific details. In other instances, detailed descriptions of well-known methods, apparatuses, and circuits are omitted so as not to obscure the description of the present invention with unnecessary details.

Figure 1:
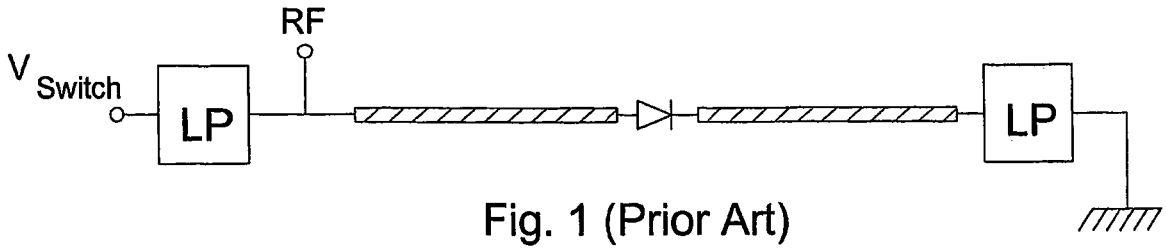
Fig. 1 (Prior Art)
FIG. 1 is a description of a prior art monopole antenna.

FIG. 1 has been described in the background section and will not be dealt with further.

Figure 2:
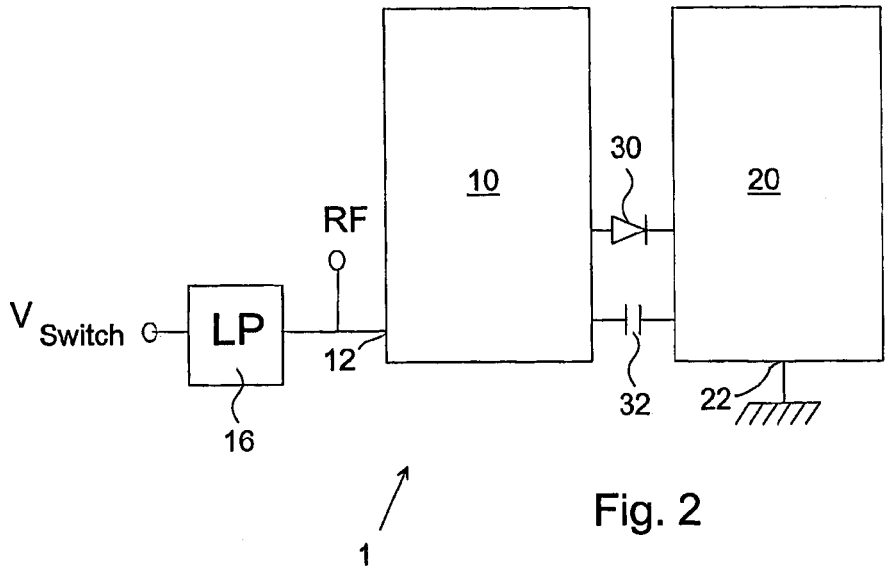
FIG. 2 shows a schematic diagram of a PIFA antenna device according to the invention.

In FIG. 2, there is shown an antenna device, generally designated 1. The antenna device comprises a first generally planar rectangular radiating element 10 made of an electrically conductive material, such as a sheet metal or a flex film, as is conventional. A source RF of radio frequency signals, such as electronic circuits of a portable radio communication device, is connected to a feeding portion 12 of the first radiating element.

The antenna device also comprises a second generally planar rectangular radiating element 20. A switch element 30 is provided between the two radiating elements 10, 20. This switch element is preferably a PIN diode, i.e., a silicon junction diode having a lightly doped intrinsic layer serving as a dielectric barrier between p and n layers. Ideally, a PIN diode switch is characterized as an open circuit with infinite isolation in open mode and as an short circuit without resistive losses in closed mode, making it suitable as an electronic switch. In reality the PIN diode switch is not ideal. In open mode the PIN diode switch has capacitive characteristic (0.1-0.4 pF) which results in finite isolation (15-25 dB @ 1 GHz) and in closed mode the switch has resistive characteristic (0.5-3 ohm) which results in resistive losses (0.05-0.2 dB).

The first and second radiating elements 10, 20 are also capacitively interconnected by means of a high pass filter, shown as a capacitor 32 in the figures. The high pass filter allows RF signals to pass and this means that the two radiating elements from an RF point of view is one single element, as will be described further with reference to FIGS. 2*a-c*.

The first and second radiating elements 10, 20 are arranged at a predetermined distance above a ground plane, such as a printed circuit board described below under reference to FIG. 3.

A DC control input, designated $V_{Switch}$ in the figures, for controlling the operation of the PIN diode is connected to the first radiating element 10 via a filter block 16 to not affect the RF characteristics of the antenna device. This means that the filter characteristics of the filter block 16 is designed so as to block RF signals. In the preferred embodiment, the filter block 16 comprises a low pass filter.

Finally, the second radiating element is connected directly to ground at a grounding portion 22. This grounding portion functions for both RF signals emanating from the RF input and DC signals emanating from the control input.

The antenna is preferably designed to 50 Ohms.

The switching of the antenna device functions as follows. The RF source and other electronic circuits of the communication device operate at a given voltage level, such as 1.5 Volts. The criterion is that the voltage level is high enough to create the necessary voltage drop across the PIN diode, i.e. about 1 Volt. This means that the control voltage $V_{Switch}$ is switched between the two voltages "high" and "low", such as 1.5 and 0 Volts, respectively. When $V_{Switch}$ is high, there is a voltage drop across the PIN diode 30 and a corresponding current there through of about 5-15 mA. This voltage drop makes the diode conductive, effectively electrically interconnecting the two radiating elements 10, 20 at the diode 30.

With the control voltage $V_{Switch}$ "low", there is an insufficient voltage drop across the PIN diode 30 to make it conductive, i.e., it is "open". The second radiating element is then effectively connected to the first radiating element only through the capacitor 32.

The size and configuration of the two radiating elements are chosen so as to obtain the desired resonance frequencies, such as the 850 and 1800 MHz bands with the switch open and the 900 and 1900 MHz bands with the switch closed.

Figure 2A:
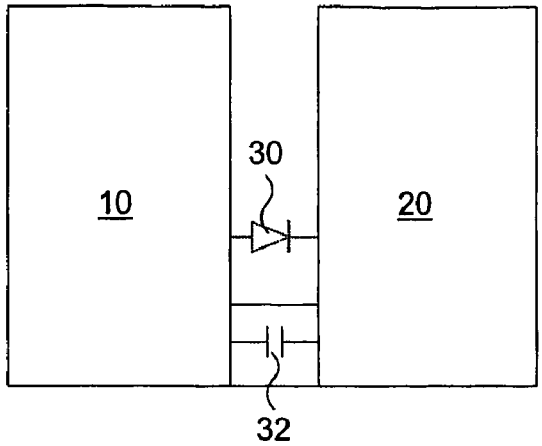
FIGS. 2*a* and 2*b* shown the PIFA antenna of FIG. 2 in a first and a second operating mode, respectively.

Now turning to FIG. 2*a*, it is shown therein how the two radiating elements 10, 20 from an RF point of view operate as one single radiating element having a general C-shape. This is because the capacitor 32, operating as a high pass filter, functions as an "RF bridge" between the two radiating elements. Switch 30 in the form of a PIN diode is open, i.e., non-conductive in FIG. 2*a* because the control voltage $V_{Switch}$ is low, i.e. zero Volts. No DC current flows through the diode. The C-shape of the combined radiating elements in combination with the position of the feeding portion 12 makes the arrangement resonate at two frequencies, effectively making it suitable for dual band operation.

Figure 2B:
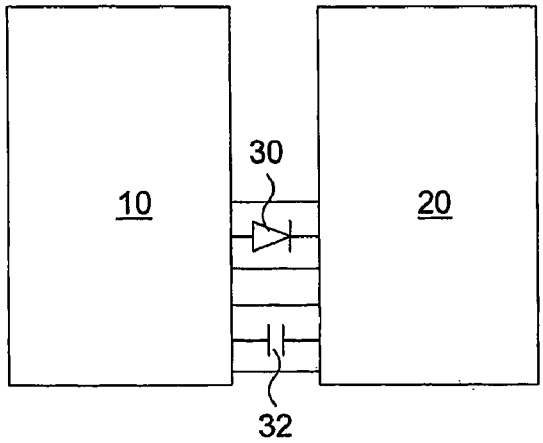

In FIG. 2*b*, switch 30 is closed, i.e., the diode is conductive. This effect is achieved when a high control voltage $V_{Switch}$ is applied to the control input, see FIG. 2. This voltage creates a DC current that flows through the LP filter 16, across the first radiating element 10, through the diode 30, across the second radiating element 20 and to ground via the grounding portion 22. With the switch 30 closed, i.e., with the diode conductive, the RF bridge between the two radiating elements is broadened. This is clearly seen in FIG. 2*b* when compared to FIG. 2*a*.

Figure 2C:
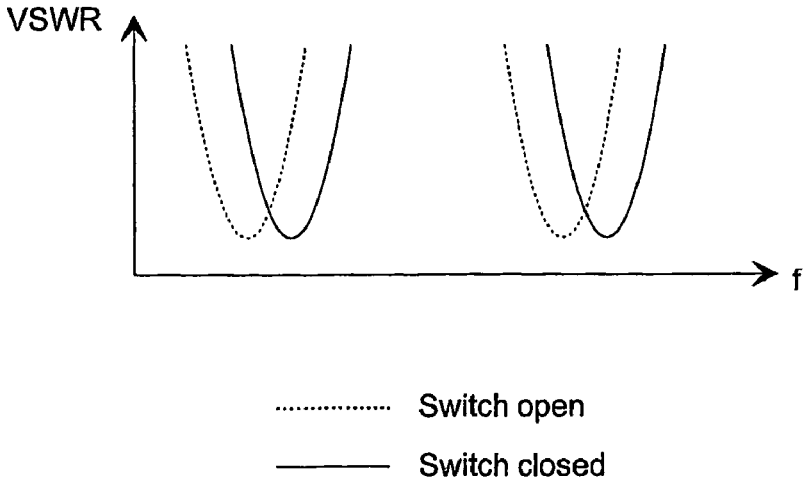
FIG. 2*c* is a frequency diagram of the operating modes of the antenna shown in FIG. 2

This change of geometry of the effective radiating elements adjusts the resonance frequencies of antenna device. This is seen in FIG. 2*c*, wherein the dashed curves correspond to the operating mode shown in FIG. 2*a* and the solid curves correspond to the operating mode shown in FIG. 2*b*. The means that an antenna device which can operate in four different frequency bands is obtained, such as the above mentioned 850/900/1800/1900 MHz bands.

The adjustment of the resonance frequencies shown in FIG. 2*c* can be used to an advantage in so-called fold phones. In this kind of communication devices, the resonance frequency of an internal antenna element tends to move downwards in frequency when the position of the phone is changed from folded to unfolded mode. With the inventive antenna device, when the phone is unfolded, the movement of the resonance frequencies can be counteracted by closing the switch 30. Thus, with the phone folded, the control voltage $V_{switch2}$ is low and with the phone unfolded, the control voltage is high. The antenna device then operates as a dual band antenna with essentially constant resonance frequency irrespective of the operating mode of the communication device (folded/unfolded).

The adjustment of the resonance frequencies shown in FIG. 2*c* can also be used to an advantage in dual band bar phones. In the frequency bands used for mobile communication, the transmit (TX) and receive (RX) frequencies are separated by approximately 45-90 MHz. By using frequency adjustment, near optimum efficiency can be obtained by adjusting the frequencies to the TX and RX frequencies instead of the broader frequency band incorporating the TX and RX frequencies.

Figure 3:
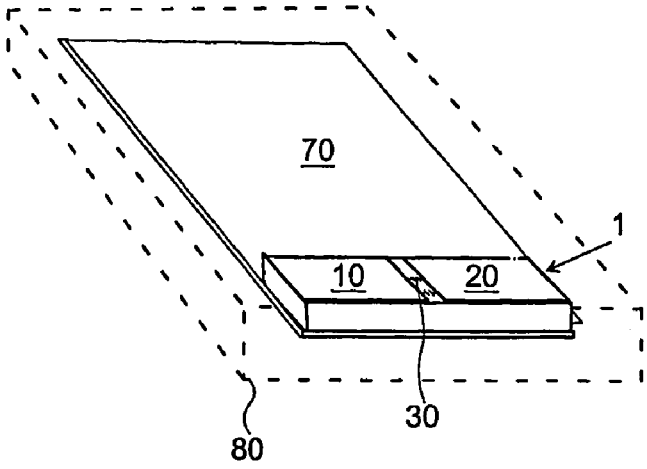
FIG. 3 is an overview of a printed circuit board arranged to be fitted in a portable communication device and having an antenna device according to the invention.

In FIG. 3 the two radiating elements 10, 20 are shown arranged generally parallel to and spaced apart from a printed circuit board (PCB) 70 adapted for mounting in a portable communication device 80, such as a mobile phone. The PCB functions as a ground plane for the antenna device. The general outlines of the communication device is shown in dashed lines in FIG. 3. Typical dimensions for the antenna device 1 is a height of approximately 4 millimeters and a total volume of about 3 $cm^3$.

It will be appreciated that all components except for the two radiating elements 10, 20, the switch element 30, and the capacitor 32 can be provided on the PCB, thus facilitating easy assembly of the antenna device. This is further facilitated by the fact that there is no separate feeding of the switch element.

A conventional production method of antenna devices is to provide an electrically conductive layer forming the radiating portions of the antenna on a carrier made of a non-conductive material, such as a polymer or other plastic material. The carrier is thus made of a heat-sensitive material and a small heating area is desired to keep the temperature as low as possible when soldering components to the antenna device.

Figure 4:
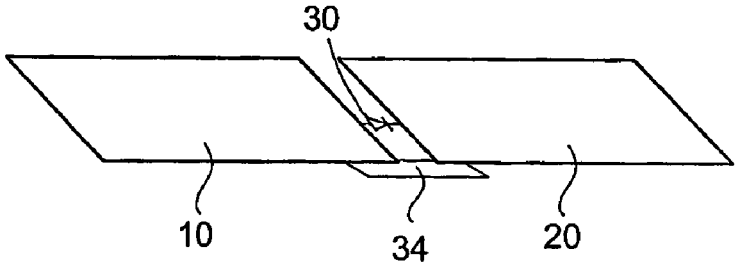
FIG. 4 shows an embodiment of the antenna device wherein capacitive coupling between radiating elements is provided by means of a conductive sheet.

In FIG. 4, there is shown how the capacitive bridge can be provided by means of a conductive sheet 34 provided under part of the two radiating elements 10, 20 at the RF bridge location. If a multi-layer flex film is used to provide the radiating elements, the radiating elements 10, 20 can be provided on one side of the flex film and the conductive sheet 34 on the other. In this way, discrete components are avoided to provide the capacitive coupling between the radiating elements.

Figure 5:
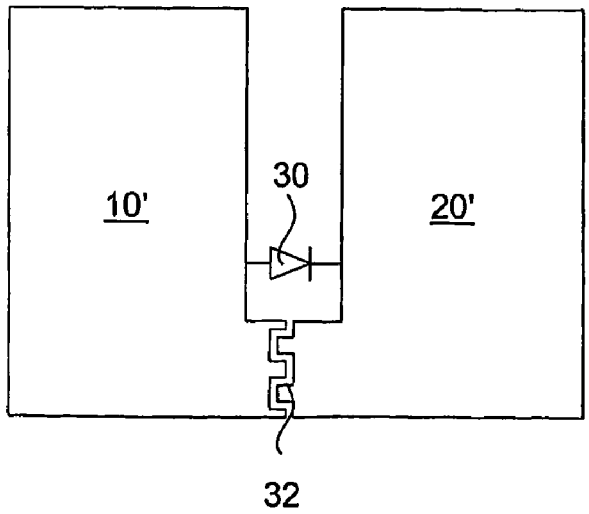
FIG. 5 shows yet another embodiment of the antenna device wherein capacitive coupling between radiating elements is provided by means of a meandering interface between the radiating elements.

In FIG. 5, there is shown how the capacitive bridge can be provided by means of a meandering interface between the two radiating elements 10, 20. Also in this way, discrete components are avoided to provide the capacitive coupling between the radiating elements.

Figure 6:
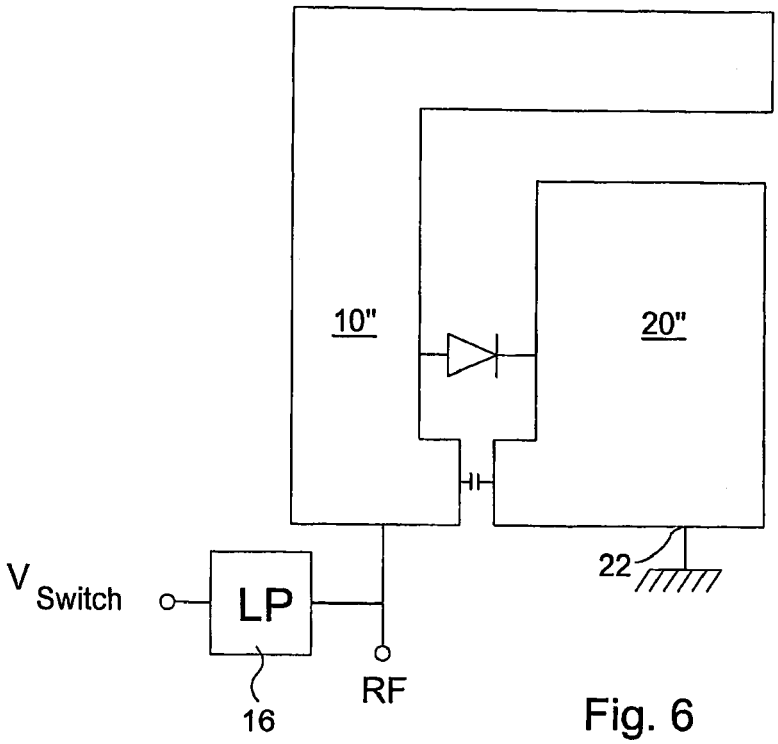
FIG. 6 shows yet another alternative radiating element configuration.

In FIG. 6 there is shown an alternative configuration of the radiating elements. In all aspects, this antenna device operates as the one described above with reference to FIGS. 2 and 2*a-c*.

Figure 7:
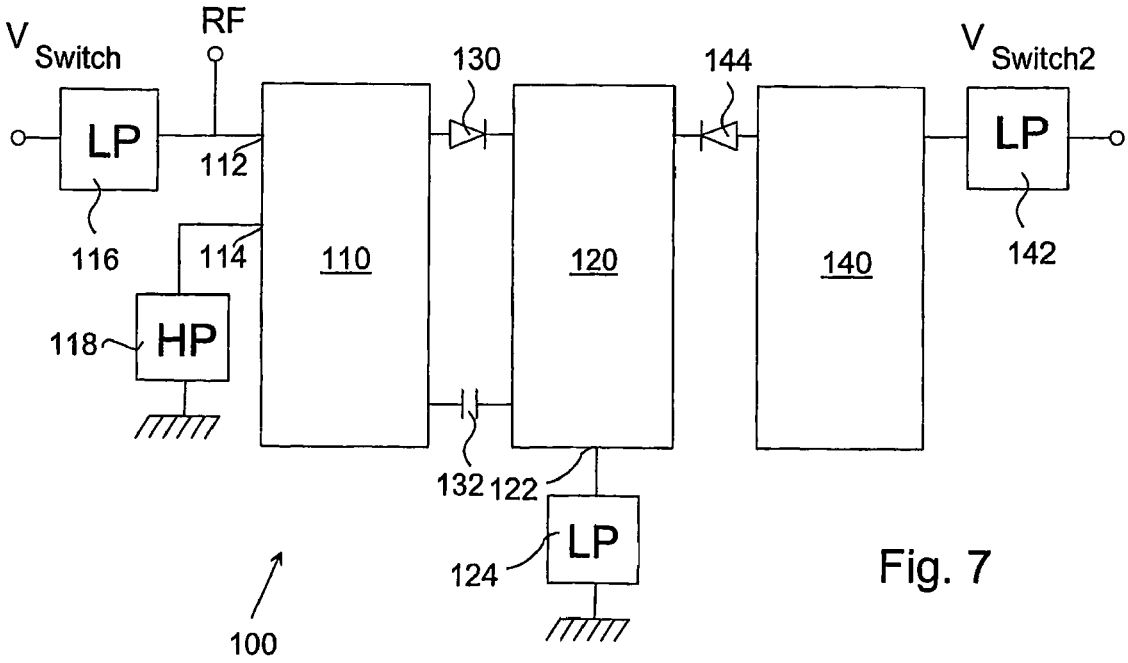
FIG. 7 shows an alternative embodiment of an antenna device according to the invention wherein three radiating elements are provided.

In an alternative embodiment shown in FIG. 7, generally designated 100, an additional third radiating element 140 is provided together with a second control input, designated $V_{switch2}$ connected to the third radiating element via a low pass filter 142. The third radiating element is connected to the second radiating element 120 by means of a second switch 144 in the form of a PIN diode.

Also, in the embodiment shown in FIG. 7, the first radiating element 110 is connected to ground at a grounding portion 114 via a high pass filter 118 blocking DC signals. Finally, the second radiating element 120 is connected to ground at a grounding portion 122 via a low pass filter 124 blocking RF signals. Thus, in this embodiment, there are separate grounding portions for RF signals and DC (i.e., control) signals.

The antenna device of FIG. 7 operates as follows. The first control voltage $V_{switch}$ functions as in the first embodiment shown in FIG. 2. Thus, high voltage creates a current flowing through the first switch 130 and to ground through the low pass filter 124. With the second control voltage $V_{switch2}$ low, the second switch 144 is non-conductive. This means that the third radiating element 140 is effectively disconnected from the second radiating element, see FIGS. 7*a* and 7*b*.

Figure 7A:
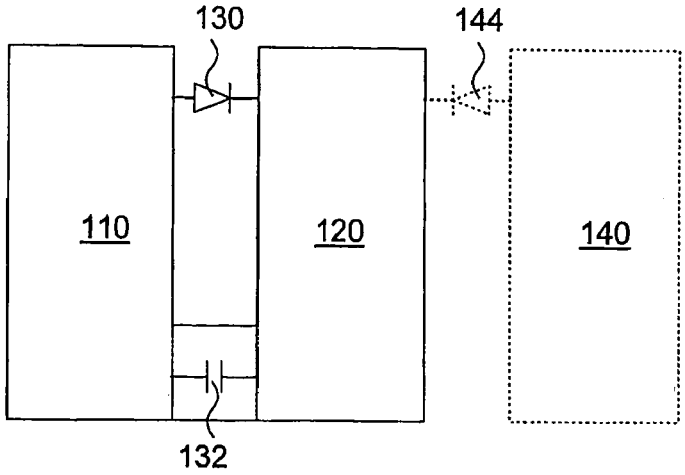
FIGS. 7*a-d* show different operating modes of the antenna device shown in FIG. 7.
Figure 7B:
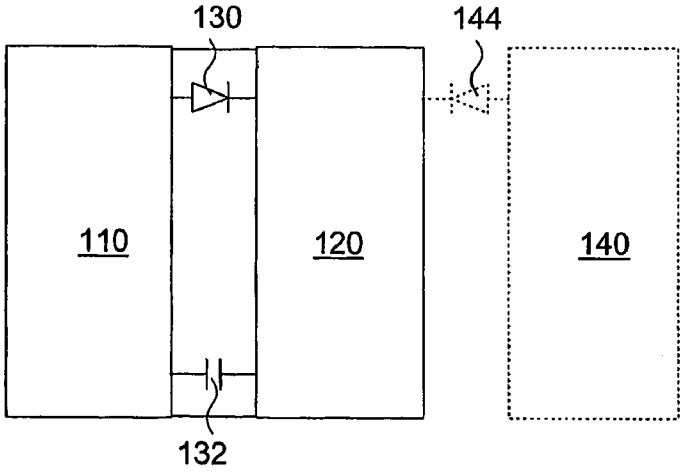

With the position of the feeding portion 112 and the first switch 130 open as in FIG. 7*a*, the first and second radiating elements 110, 120 interconnected by means of the capacitor 132 resonates at a first frequency. With the first switch closed as in FIG. 7*b*, the combination of the first and second radiating elements resonates at a second frequency.

Figure 7C:
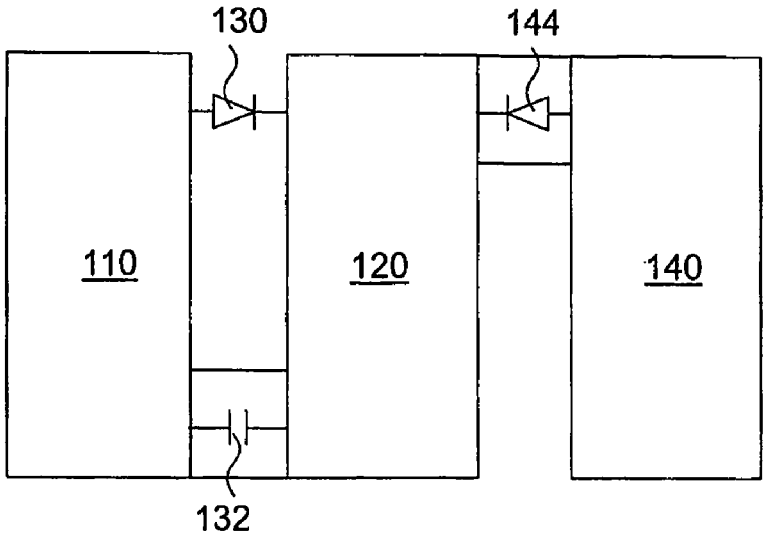
Figure 7D:
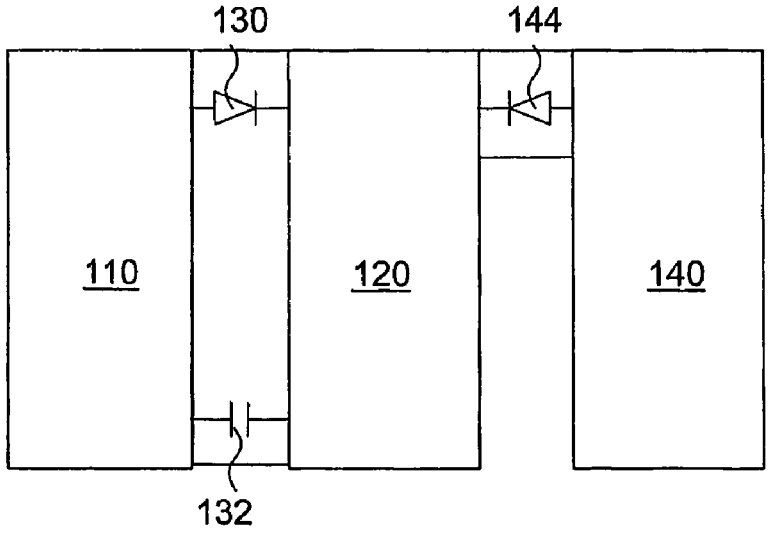
Figure 8:
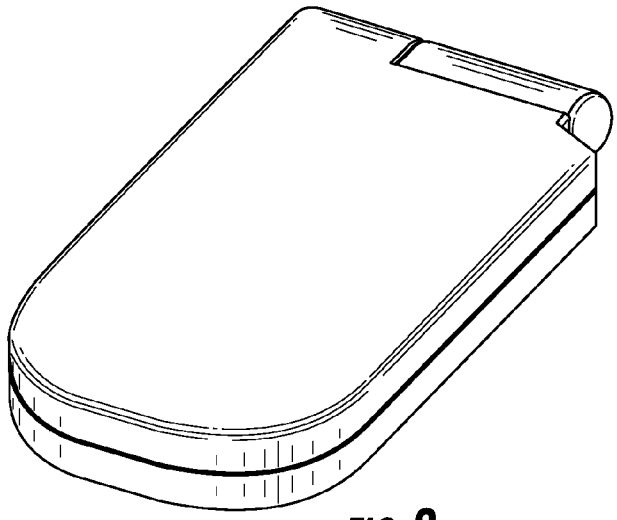
FIG. 8 is a perspective view of an exemplary foldable phone in which may be used the PIFA antenna shown in FIG. 2 according to an exemplary embodiment.
Figure 9:
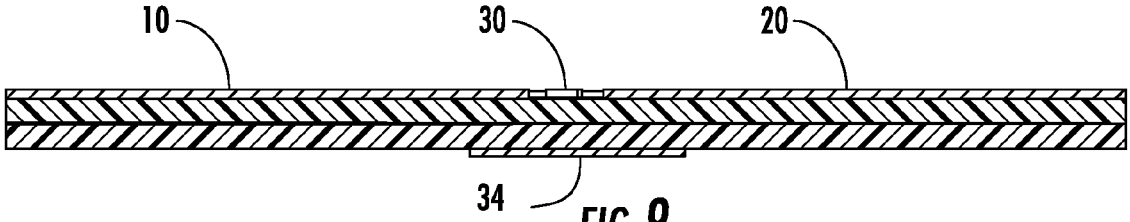
FIG. 9 is a side view of an example embodiment in which radiating elements (shown in FIG. 4) are on one side of an example multi-layer flex film and the conductive sheet (also shown in FIG. 4) are on the other side of the multi-layer flex film.

With the second switch 144 closed as in FIGS. 7*c*, 7*d*, i.e., with the second control voltage high, the combination of the first, second, and third radiating elements 110, 120, 140 resonates at a third or fourth frequency, depending on whether the first switch 130 is open or closed. Thus, quad band operation is provided with this configuration.

Preferred embodiments of an antenna device according to the invention have been described. However, it will be appreciated that these can be varied within the scope of the appended claims. Thus, a PIN diode has been described as the switch element. It will be appreciated that other kinds of switch elements can be used as well.

The radiating elements in FIGS. 2, 3, and 7 have been described as being essentially planar and generally rectangular. It will be appreciated that the radiating elements can take any suitable shape, such as being bent to conform with the casing of the portable radio communication device in which the antenna device is mounted.

One switch has been shown to interconnect two radiating elements. It will be appreciated that more than one switch, such as several parallel PIN diodes can be used without deviating from the inventive idea.

The invention claimed is:

1. An antenna device for a portable radio communication device operable in at least a first and a second frequency band, the antenna device comprising:

a first electrically conductive radiating element having a feeding portion connectable to a feed device (RF) of the radio communication device;

a second electrically conductive radiating element having a grounding portion connectable to ground;

a controllable switch connected between the first and second radiating elements for selectively interconnecting and disconnecting the radiating elements, the state of the switch being controlled by means of a control voltage input ($V_{Switch}$);

a first filter connected between the feeding portion and the control voltage input ($V_{Switch}$), wherein the first filter is arranged to block radio frequency signals;

a high pass filter connected between said first and second radiating elements, which high pass filter provides an RF bridge between the first and second radiating elements and thereby allows RF signals to pass, so that the first and second radiating elements are operable as one single radiating element.

2. The antenna device according to claim 1, wherein the controllable switch comprises a PIN diode.

3. The antenna device according to claim 1, wherein the first filter is a low pass filter.

4. The antenna device according to claim 1 wherein the second radiating element is connected directly to ground.

5. The antenna device according to claim 1, wherein the first and second radiating elements together with the high pass filter have a general C-shape.

6. The antenna device according to claim 1, wherein the high pass filter comprises a conductive sheet provided under part of the two radiating elements, thereby providing the RF bridge.

7. The antenna device according to claim 6, comprising a multi-layer flex film wherein the radiating elements are provided on one side of the flex film and the conductive sheet is provided on the other side of the flex film.

8. The antenna device according to claim 1, wherein the high pass filter comprises a meandering interface between the first and second radiating elements.

9. The antenna device according to claim 1, comprising a third radiating element together with a second control input ($V_{switch2}$) connected to the third radiating element via third filter being a low pass filter, wherein the third radiating element is connected to the second radiating element by means of a second switch, and further comprising a second grounding portion arranged on the first radiating element which is connected to ground via a second high pass filter blocking DC signals, and a fifth filter being a low pass filter arranged between the second radiating element and ground.

10. The antenna device according to claim 1, wherein the high pass filter comprises a capacitor.

11. The antenna device according to claim 1, wherein said first and second radiating elements are generally planar and arranged at a predetermined distance above a ground plane.

12. The antenna device according to claim 1, wherein at least one of the first and second radiating elements includes at least a portion bent to conform with a casing of the portable radio communication device in which the antenna device is mounted.

13. An antenna device for a portable radio communication device operable in at least a first and a second frequency band, the antenna device comprising:

a first electrically conductive radiating element having a feeding portion connectable to a feed device of the radio communication device;

a second electrically conductive radiating element having a grounding portion connectable to ground, said first and second radiating elements are generally planar and arranged at a predetermined distance above a ground plane;

a controllable switch arranged between the first and second radiating elements for selectively interconnecting and disconnecting the radiating elements, the state of the switch being controlled by means of a control voltage input ($V_{Switch}$);

a first filter arranged between the feeding portion and the control voltage input ($V_{Switch}$), wherein the first filter is arranged to block radio frequency signals;

a high pass filter connected between said first and second radiating elements, which high pass filter allows RF signals to pass;

a third radiating element together with a second control input ($V_{switch2}$) connected to the third radiating element via a low pass filter, wherein the third radiating element is connected to the second radiating element by means of a second switch; and a second grounding portion arranged on the first radiating element which is connected to ground via a second high pass filter blocking DC signals, and a low pass filter arranged between the second radiating element and ground.

14. A portable radio communication device, comprising a generally planar printed circuit board and an antenna device connected to a feed device (RF) with electronic circuits provided for transmitting and/or receiving RF signals, and a ground device, wherein the antenna device comprises:

a first electrically conductive radiating element having a feeding portion connectable to a feed device (RF) of the radio communication device;

a second electrically conductive radiating element having a grounding portion connectable to ground;

a controllable switch arranged between the first and second radiating elements for selectively interconnecting and disconnecting the radiating elements, a state of the switch being controlled by means of a control voltage input ($V_{Switch}$);

a first filter arranged between the feeding portion and the control voltage input ($V_{Switch}$), wherein the first filter is arranged to block radio frequency signals;

a high pass filter connected between said first and second radiating elements, which high pass filter provides an RF bridge between the first and second radiating elements and thereby allows RF signals to pass, so that the first and second radiating elements are operable as one single radiating element.

15. The portable radio communication device according to claim 14, wherein the communication device is a foldable phone;

a control voltage applied to the control voltage input ($V_{Switch}$) is low when the communication device is folded; and the control voltage applied to the control voltage input ($V_{Switch}$) is high when the communication device is unfolded;

whereby the antenna device operates as a dual band antenna with essentially constant resonance frequencies irrespective of the operating mode of the communication device.

16. The portable radio communication device according to claim 14, wherein a control voltage applied to the control voltage input ($V_{Switch}$) is low when the communication device operates in a transmit mode; and the control voltage applied to the control voltage input ($V_{Switch}$) is high when the communication device operates in a receive mode.

17. The portable radio communication device according to claim 14, wherein the high pass filter comprises a capacitor or a meandering interface between the first and second radiating elements.

18. The portable radio communication device according to claim 14, wherein the high pass filter comprises a conductive sheet provided under part of the two radiating elements, thereby providing the RF bridge.

19. The portable radio communication device according to claim 14, wherein said first and second radiating elements are generally planar and arranged at a predetermined distance above a ground plane.

20. The portable radio communication device according to claim 14, wherein at least one of the first and second radiating elements includes at least a portion bent to conform with a casing of the portable radio communication device in which the antenna device is mounted.

* * * * *